US005111970A

United States Patent [19]

Rutter et al.

[11] Patent Number: 5,111,970

[45] Date of Patent: May 12, 1992

[54] FLUID DISPENSER HAVING A REMOVABLE SEALING DIAPHRAGM

[75] Inventors: Christopher C. Rutter, Oakland; Terry Quashnick, Lodi, both of Calif.

[73] Assignee: Rapak, Inc., Hayward, Calif.

[21] Appl. No.: 667,870

[22] Filed: Mar. 12, 1991

[51] Int. Cl.[5] ..... B67B 7/24

[52] U.S. Cl. ..... 222/83; 222/91; 222/105

[58] Field of Search ..... 222/81, 83, 89, 90, 222/91, 107, 501, 505, 553, 541, 105

[56] References Cited

U.S. PATENT DOCUMENTS

| | | | |
|---|---|---|---|
| 2,947,315 | 8/1960 | Connell | 222/541 |
| 3,642,172 | 2/1972 | Malpas | 222/90 |
| 4,322,018 | 3/1982 | Rutter | 222/83 |
| 4,325,496 | 4/1982 | Malpas | 222/90 X |
| 4,355,737 | 10/1982 | Pongrass et al. | 222/81 |
| 4,469,249 | 9/1984 | Malpas et al. | 222/83 |
| 4,475,670 | 10/1984 | Rutter | 222/83 |
| 4,493,438 | 1/1985 | Rutter | 222/83 |
| 4,600,127 | 7/1986 | Malpas et al. | 222/83 |
| 4,619,377 | 10/1986 | Roos | 222/83 |
| 4,624,392 | 11/1986 | Malpas et al. | 222/89 X |

FOREIGN PATENT DOCUMENTS

| | | | |
|---|---|---|---|
| 0340554 | 11/1989 | European Pat. Off. | 222/541 |
| 2233315 | 1/1991 | United Kingdom | 222/541 |

*Primary Examiner*—Michael S. Huppert
*Assistant Examiner*—Anthoula Pomrening
*Attorney, Agent, or Firm*—Majestic, Parsons, Siebert & Hsue

[57] ABSTRACT

A fluid dispenser operable between opened and closed positions is adapted for attachment to a flexible bag that contains a liquid, particulate matter or other fluid material, where an opening is provided through a wall of the bag into an interior of the dispenser. The dispenser is initially closed to fluid flow, for the purpose of storage and shipping, by a diaphragm that is cut the first time the dispenser is operated to its opened position. A specially designed diaphragm cutting track and cooperative knife shape cause a cut diaphragm flap to be pushed out of the fluid flow path through the dispenser.

13 Claims, 5 Drawing Sheets

FLUID DISPENSER HAVING A REMOVABLE SEALING DIAPHRAGM

BACKGROUND OF THE INVENTION

This invention relates generally to fluid dispensers, and specifically to a class of fluid dispensers adapted for attachment to fluid containers such as flexible plastic bags.

The use of plastic bags as fluid containers has become widespread, particularly in certain applications. For example, food liquids, such as milk and wine, are commonly packaged and distributed in plastic bags. The filled bags are usually carried in a cardboard box. A rigid plastic dispenser is attached to the bag in a manner to extend through the box in order to dispense liquid from the bag. The dispenser normally includes a valve which is operated between open and closed positions by the ultimate user of the product, in order to periodically remove liquid from the bag. As liquid is removed from the flexible plastic bag, the bag collapses around the remaining liquid. Since it is unnecessary that air be introduced into the container in order to remove liquid, air does not come into contact with the remaining food material in the bag.

During shipping and storage, the bag remains sealed. One type of commercial dispenser includes a cutting element for making an opening in the bag wall. The first time the dispenser is operated to withdraw fluid from the bag, the cutting element cuts a hole in the bag wall. Prior to this time, the bag has remained totally sealed. A manually operated valve provided as part of the dispenser thereafter controls flow of the fluid out of the bag through the bag opening. Such an arrangement is described in U.S. Pat. No. 4,355,737 Pongrass and Rutter (1982). When this type of dispenser is used, the bag is initially filled through an opening that is heat sealed shut after filling.

Another type of commercial dispenser is attached to a bag that includes a hole pre-punched in its wall. Before attaching the dispenser to the bag, it is filled through the hole with liquid, particulate material, or other fluid desired to be stored and shipped in it. A rigid plastic spout is usually first attached to the bag around the hole. A dispenser is then attached to the spout and seals the bag opening by a diaphragm extending across the fluid passage within the dispenser. This diaphragm is then cut when the user first opens the dispenser valve to remove fluid from the bag. An example of this type of dispenser is given in Canadian Patent No. 1,206,923—Rutter (1986). In this dispenser, a semicircle is cut in the diaphragm, leaving a flap that is moved out of the dispenser fluid passage by fluid flow through it from the bag.

Although the valves provided as part of either of these two types of dispensers are quite adequate for closing off fluid flow once use of the bag is commenced, the simple structure of such valves is usually not relied upon to prevent fluid loss during extended storage and shipment. That is why the bag is otherwise sealed during such storage and shipment, this seal being broken when the valve of the dispenser is first operated to an open position by the end user of the container.

It is an object of the present invention to provide a dispenser of the type having a sealing diaphragm therein with an improved structure for breaking the seal and allowing free fluid flow through the dispenser after the seal is broken.

SUMMARY OF THE INVENTION

According to one aspect of the present. invention, a cutting track of reduced thickness is provided in the dispenser diaphragm seal in a somewhat semicircular path over which a blade travels when the dispenser valve is first operated to its open position. This track is provided with a varying width and depth in order to both make it easy to be cut by the blade and cause the resulting diaphragm flap to be positively pushed out of the dispenser fluid path so that it does not impede fluid flow out of the bag as the dispenser valve is repeatedly operated between opened and closed positions until the contents of the bag are exhausted. A portion of the track that is initially cut is made to be quite thin and narrow in order to reduce the amount of force necessary to be applied to the dispenser valve by hand in order to start the cut of the diaphragm. A later portion of the cutting track is made to be thicker and wider in order that the diaphragm flap being cut is pushed out of the way of the fluid passage by the cutting action.

According to another aspect of the present invention, an opposite side of the blade element is bluntly shaped in order that operation of the dispenser valve from its opened to its closed position additionally pushes the diaphragm flap out of the fluid passage. A notch near the tip of the cutting element on its back side allows this pushing motion to occur without being limited by the uncut portion of the diaphragm. Thus, the diaphragm flap is further pushed out of the way of the liquid passage when the dispenser valve is closed by hand at the conclusion of a first quantity of fluid being withdrawn through it from the bag.

Additional objects, features and advantages of the various aspects of the present invention will become apparent from the following description of a preferred embodiment thereof, which description should be taken in conjunction with the accompanying drawings.

DESCRIPTION OF A PREFERRED EMBODIMENT

Figure 1:
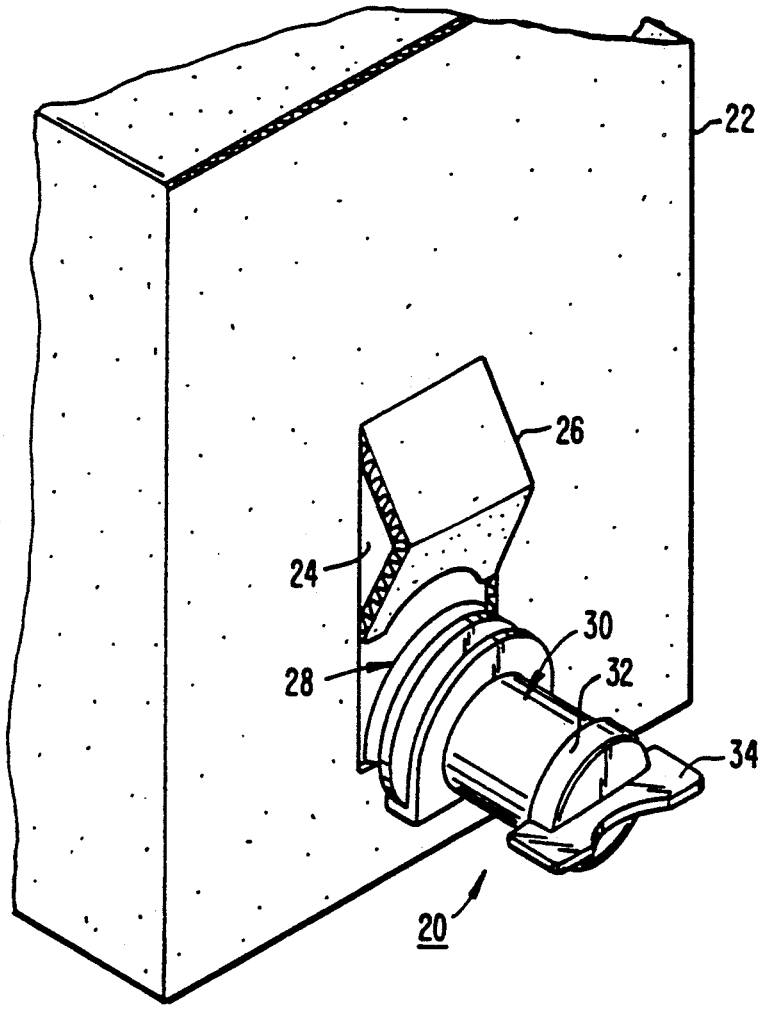
FIG. 1 illustrates a bag-in-box container in which the improved dispenser of the present invention is advantageously utilized.

Referring initially to FIG. 1, a typical bag-in-box container is illustrated in which the improved dispenser of the present invention may be utilized. A dispenser 20 is mounted in an operating position in a cardboard carton 22 which houses a flexible plastic bag 24 containing a fluid to be dispensed. During storage and shipping, the dispenser 20 is stored within the carton 22 and, when ready for use, is removed through an opening in the carton which is normally closed by a flap 26.

Figure 2:
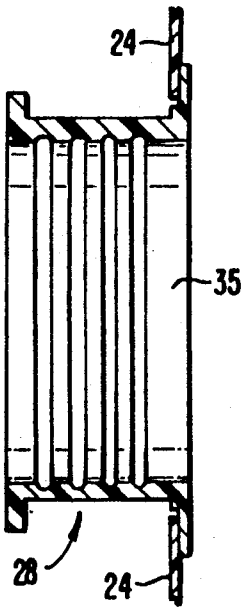
FIGS. 2, 3, and 4 show, in separate cross-sectional views, three parts which are assembled together to form the dispenser of FIG. 1.
Figure 3:
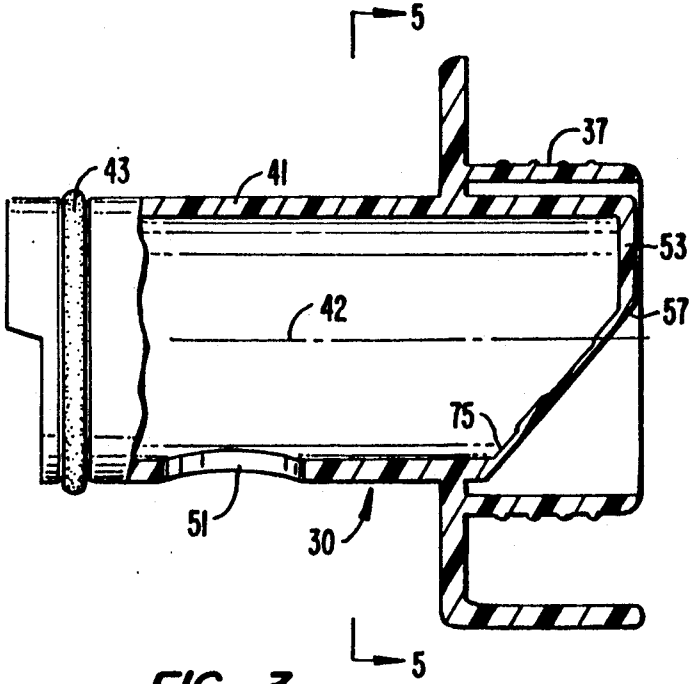
Figure 9:
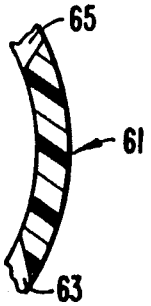
FIG. 9 is a cross-sectional view of a portion of the part of FIG. 4, taken at section 9—9 of FIG. 4.

The dispenser 20 is formed of three separate molded plastic parts which snap fit together. A first part is a spout 28 attached to the bag 24 in a manner, as best shown by FIG. 2, wherein a cylindrically shaped opening 35 thereof is in direct fluid communication with an interior of the bag 24 through a bag wall opening. A body 30, as a second dispenser part best shown in FIG. 3, contains rings on a cylindrically shaped end surface 37 which match grooves on an interior cylindrically shape surface of the spout 28. The end surface 37 is dimensioned to fit snugly within the spout 28. Their cooperating rings and grooves hold the parts 28 and 30 from relative axial movement between them, and also provide a fluid seal. The body 30 includes a open sleeve 41 having a cylindrical shape about a longitudinal axis 42.

Figure 4:
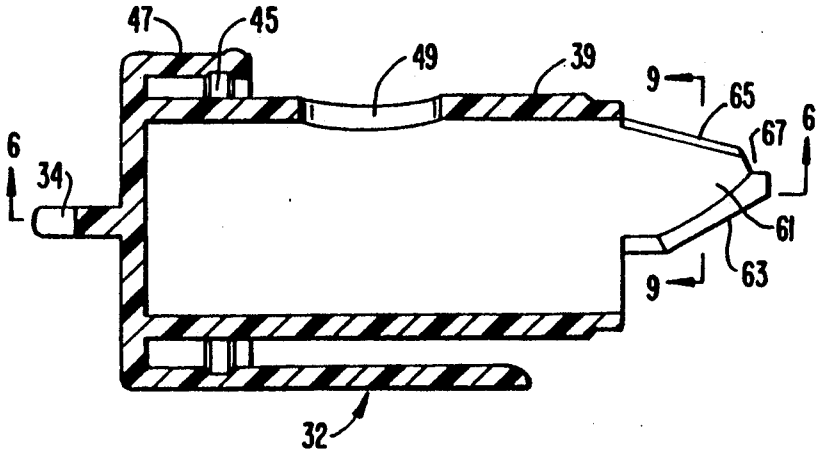

A third part 32 of the dispenser, as best shown in FIG. 4, has a cylindrical shell 39 that fits snugly within the sleeve 41 of the body part 30. A ring 43 on the outside of the sleeve 41 fits within a matching groove 45 on an inside surface of an outer cylindrically shaped piece 47. This interconnection of the ring 43 and groove 45 prevents axial motion between the body 30 and valve member 32, while allowing the valve member 32 to be rotated with respect to the body 30. The interconnecting elements 43 and 45 also provide some degree of fluid seal between the parts 30 and 32. The valve member 32 is rotated with respect to the body 30 by hand manipulation of a handle 34. The three pieces 28, 30 and 32 are preferably formed by injection plastic molding and are force-fit together to form the dispenser 20.

A hand operated valve is provided in the dispenser by two openings, an opening 49 in the shell 39 and an opening 51 in the sleeve 41. When the valve member 32 is in the rotatable position shown in FIG. 4 with respect to the body 30 of FIG. 3, it can be seen that the valve is closed since each of the openings is covered by a wall portion of the other piece. However, when the valve member 32 is rotated 180 degrees, it can be seen that the openings 49 and 51 align, thus providing a path for fluid to escape the dispenser from an internal passage within the shell 39.

Initially, that internal dispenser fluid path is isolated from the interior of the bag 24 by an end of the cylindrical sleeve 41 being closed off by an end piece 53 and diaphragm 55 that are integrally formed with each other and with the remaining portions of the body 30 as a single injection molded part. The end piece 53 is thick enough so as to be as rigid as other wall portions of the body 30, and extends across the end opening of the sleeve 41 to cover less than one-half its internal cross-sectional area. The diaphragm 55 joins the end piece 53 along a straight line 57 that extends across that opening. The diaphragm 55 is molded to be thinner so that a flap can be cut in it and moved out of the way of fluid flow from within the bag and into the interior fluid passage of the dispenser shell 39.

A knife 61 is integrally formed at an end of the shell 39 of the part 32. A sharp cutting edge 63 is provided on one side of the knife 61 along the outside surface which contacts and rides along an inside surface of the sleeve 41 when the valve member 32 is rotated. A more blunt surface 65 is provided on an opposite side of the knife 61, with a notch 67 formed along that side of the knife and adjacent its tip.

Figure 10A:
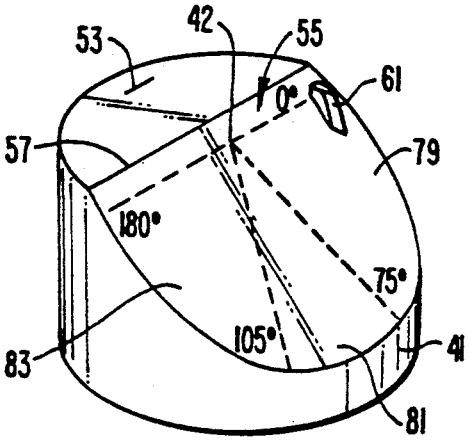
FIGS. 10A, 10B, 10C and 10D illustrate different stages of operation of the parts of FIGS. 3 and 4.
Figure 10B:
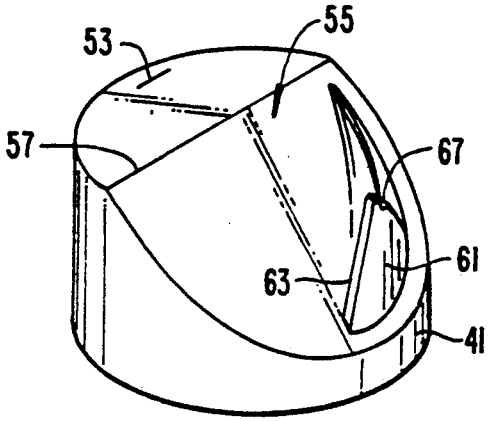
Figure 10C:
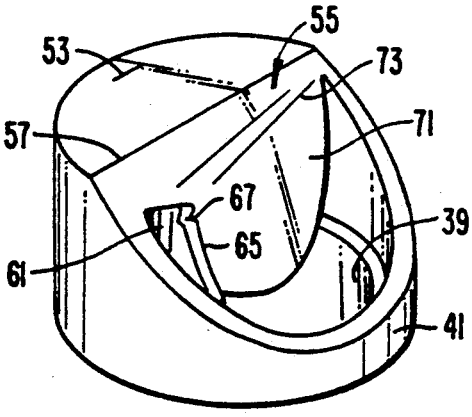

The knife 61 makes an arcuate cut through the diaphragm 55 along its outer edge adjacent the sleeve 41 when the valve member 32 is rotated from its closed position (as shown in FIG. 4) with respect to the body member 30 (with a position shown in FIG. 3), one-half revolution to cause the openings 49 and 51 to align with each other. This cutting action is illustrated in four states in the four views of FIG. 10. In FIG. 10A, rotation of the valve member 32 has just begun and the knife 61 has just penetrated the diaphragm 55. In the view of FIG. 10B, the knife 61 is shown to be in a position resulting from the valve member 32 being rotated through an angle of about 90 degrees with respect to the body member 30. FIG. 10C shows the cut of the diaphragm to be complete, resulting from the valve member 32 having been rotated 180 degrees with respect to the body 30 from the initial positions shown in FIGS. 3 and 4.

Figure 10D:
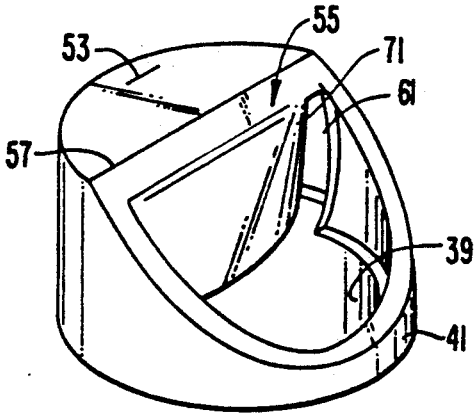

This cutting operation causes a diaphragm flap 71 to bend about a line 73 into an interior of the sleeve 41. A fluid passage is then opened into an interior of the shell 39 from the inside of the bag 24. When the valve member 32 is rotated into the position shown in FIG. 10C, the valve openings 49 and 51 are aligned and fluid is dispensed. When it is desired to stop the flow of fluid from the dispenser, the valve member 32 is rotated 180 degrees back to its beginning position, which is shown in FIG. 10D.

The diaphragm 55 and knife 61 are cooperatively shaped to cause the diaphragm flap 71 to be initially forced inward of the sleeve 41 and then to stay there during repeated operations of the valve member 32 between opened and closed positions. It is important that this always occur. The consequence of the flap 71 moving out of the shell 41, rather than being held down within it, is to interfere with fluid flow through the dispenser out of the bag. At the same time, it is highly desirable to minimize the rotatable force necessary for operating the valve member 32 to cut away the diaphragm. These goals are reached by specific shapes of the diaphragm 55 and knife 61.

Discussing the shape of the diaphragm first, a controlled, continuous track 75 is provided around the edge of the diaphragm 55 immediately adjacent an inner surface of the sleeve 41 where the cutting edge 63 of the knife 61 rides as the diaphragm is cut. An arrow 77 on the cross-sectional views of FIGS. 7 and 8 show the position of the knife cutting edge 63 within the track.

Figure 5:
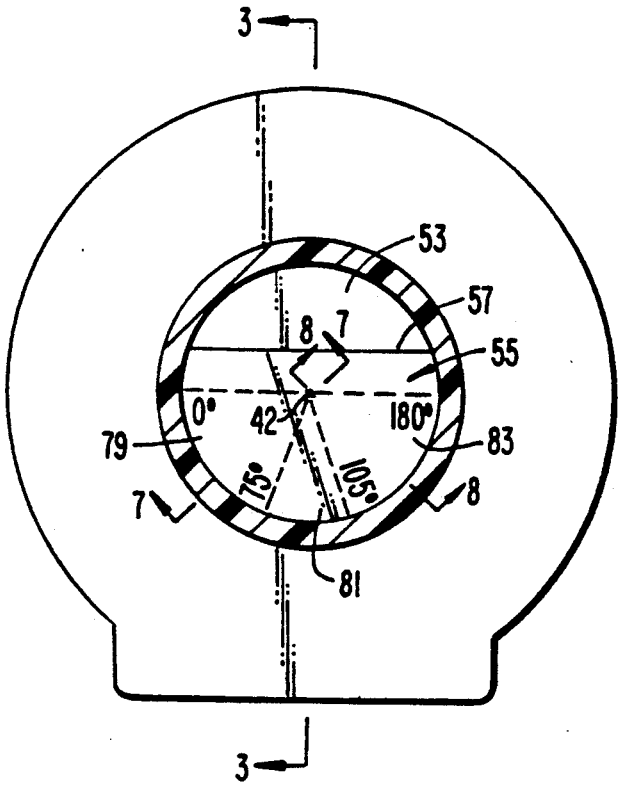
FIG. 5 is a cross-sectional view of the part of FIG. 3, taken across section 5—5 thereof.
Figure 6:
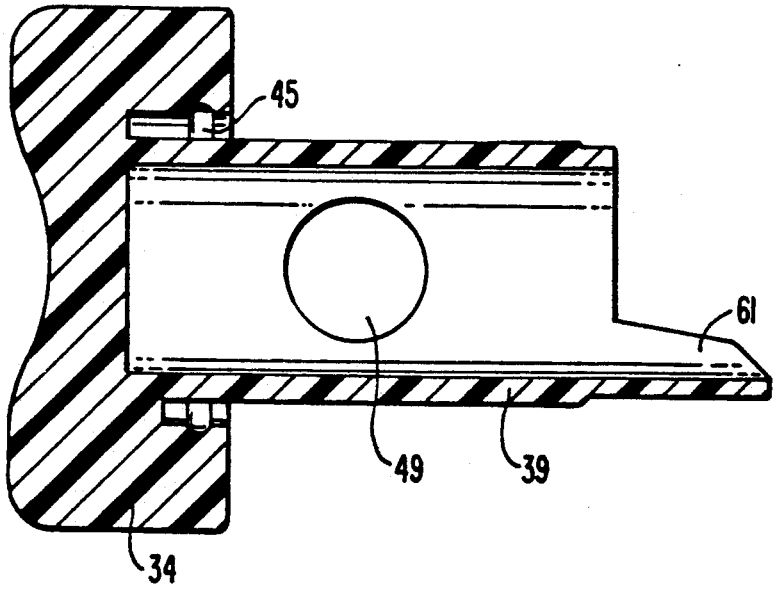
FIG. 6 is a cross-sectional view of the part of FIG. 4, taken at section 6—6 thereof.

An initial segment of the track 75, indicated to extend over a sector 79 (FIGS. 5 and 10A), represents a rotation of the valve member 32 from the position shown in FIG. 4 through an angle of about 75 degrees. The track in that region, as shown in the detailed expanded view of FIG. 7, is quite thin and narrow. This structure makes it easy for the knife cutting edge 63 to cut through the diaphragm in the track. But as the knife edge approaches a middle of its cutting arc, at about 75 degrees in this specific example, it enters a second segment of the track 75 having a shape indicated in FIG. 3 and extending over a sector 81 (FIGS. 5 and 10A). In this track sector, the diaphragm thickness is increased and made much wider. Although more force is required to rotate the valve member 32 when the knife edge is within the sector 81, the thicker and wider track has a beneficial effect of causing the diaphragm flap to be pushed inward of the sleeve 41.

Figure 7:
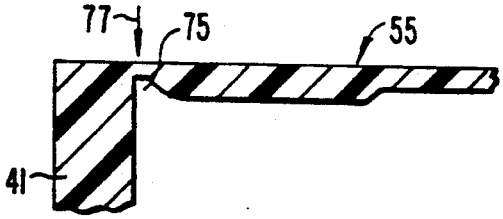
FIGS. 7 and 8 are enlarged cross-sectional views of a portion of the part shown in FIGS. 3 and 5, taken at respective sections 7—7 and 8—8 of FIG. 5.
Figure 8:
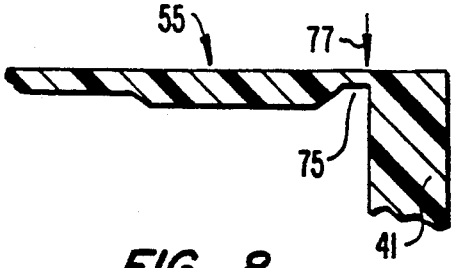

But after the knife edge 63 passes out of this middle segment of the track, such a desirable downward force will not occur from the cutting action to the same degree, so a final segment of the cutting track 75 in a sector 83 (FIGS. 5 and 10A) is made to again be thinner, as illustrated in the expanded cross-sectional view of FIG. 8, but not as narrow as the initial segment illustrated in FIG. 7. This last segment is a compromise between a track width that is wide enough to provide for some downward motion of the flap as the result of the cutting action, and yet thin enough to make it easy to cut.

Figure 11A:
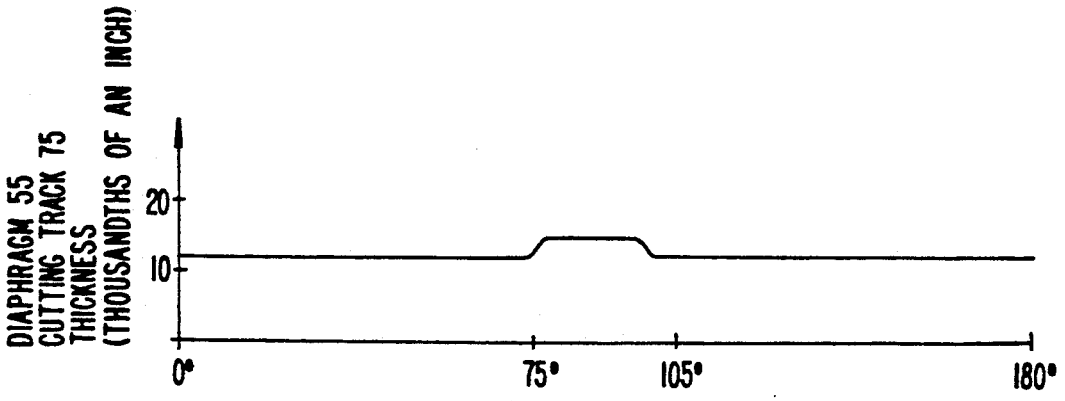
FIGS. 11A and 11B graphically illustrate relative dimensions of a portion of the part shown in FIGS. 3, 5, 7 and 8.
Figure 11B:
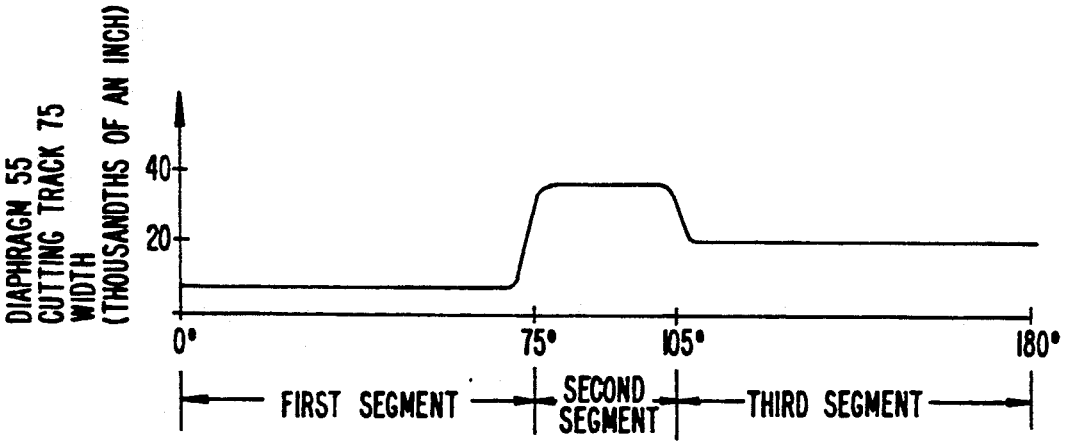

The relative thickness of the track 75 in its three segments is illustrated in FIG. 11A, with dimensions given for a specific example. Similarly, FIG. 11B illustrates the relative width of the diaphragm track 75, with reference to a specific quantitative example.

As the valve is closed, the knife 61 moves to a position illustrated in FIG. 10C. As it does so, its blunt edge 65 pushes against an edge of the diaphragm flap 71 and bends at least a portion of it under the uncut diaphragm portion and the thick end piece 53. The notch 67 allows the side 65 of the knife 61 to push the diaphragm flap 71 further out of the dispenser fluid passage than would be possible if the notch was not there.

If the notch 67 is not provided in the knife 61, travel of the blade 61 in returning to the position shown in FIG. 10D is blocked by its tip abutting a portion of the flap 71 close to the bend 73 where it is quite stiff. The flap is then not pushed as far out of the way of the fluid flow path, because of the limited travel of the blunt knife side 65.

Although the arcuate extent of the three diaphragm segments 79, 81 and 83 are shown in FIGS. 5, 10A, 11A and 11B to be 75°, 30° and 75°, respectively, it may be desirable in many circumstances to increase the extent of the middle segment 81, making it about 90°, for example. The beginning segment 79 and ending segment 83 are then each made to extend over about 45°.

Although the various aspects of the present invention have been described with respect to a preferred embodiment thereof, it will be understood that the invention is entitled to protection within the full scope of the appended claims.

IT IS CLAIMED:

1. A fluid dispenser, comprising:

a first tubular member having a first fluid outlet in one sidewall thereof, a second tubular member having a second fluid outlet in one sidewall thereof and positioned within said first tubular member in a manner to be rotatable with respect thereto about a common longitudinal axis between a first position wherein said first and second fluid outlets are aligned and a second position wherein said first and second outlets are substantially sealed by an overlap of sidewalls of respective second and first tubular members, whereby fluid flow is permitted from within said second tubular member and out of said first and second outlets when said second tubular member is in its said first rotatable position while closing off such fluid flow when said second tubular member is in its second rotatable position, a diaphragm positioned at one end of said first tubular member at an acute angle with respect to said longitudinal axis and sealing said first tubular member one end, said diaphragm having a cutting track of reduced thickness formed adjacent the sidewall of said first tubular member for a portion of a circumference thereof and having first, second and third segments, the first track segment being of a given thickness and width, the second track segment having a greater thickness and width than the first segment, and the third track segment having a thickness and width that is less than those of said second segment and a width greater than that of said first segment, and a knife positioned at one end of said second tubular member and adapted to travel along said diaphragm track when the second tubular member is rotated with respect to said first tubular member from said second rotatable position to said first rotatable position, whereby a first such rotation causes the knife to cut the diaphragm along said track to form a flap that is positioned out of a fluid path into an interior of said second tubular member through said first and second tubular member one ends.

2. The fluid dispenser according to claim 1 wherein said first end of the first tubular member further includes means positioned around an outside surface thereof for sealing with an interior surface of a fluid conduit.

3. The fluid dispenser according to claim 1 which additionally includes a spout attached said first end of the first tubular member, said spout being attached to a fluid container in a manner that an interior of said container opens through said spout to the interior of said second member through its said first end after said diaphragm has been cut along said track.

4. The fluid dispenser according to claim 1 wherein a distance between said first and second rotatable positions is substantially one-hundred eighty degrees and each of said first, second and third cutting track segments is less than ninety degrees in extent.

5. The fluid dispenser according to claim 1 wherein said diaphragm extends across less than all of the first tubular member said one end, an end piece having a thickness greater than that of said diaphragm and positioned substantially orthogonally to said longitudinal axis extending across a remaining portion of said first tubular member one end.

6. The fluid dispenser according to claim 5 wherein said first tubular member including said diaphragm and end piece formed as a single injection molded part.

7. The fluid dispenser according to claim 1 wherein said knife includes a sharp edge along one side thereof that is its leading side as it cuts through said diaphragm along said cutting track in response to said second tubular member being rotated from its said second position to its said first position, an opposite side of said knife being blunt in order to push the cut diaphragm flap out of the fluid passage as the second member is rotated from said first position and back to said second position.

8. The fluid dispenser according to claim 7 wherein said knife additionally includes a notch in said opposite side adjacent a tip thereof, thereby allowing the cut diaphragm flap to be pushed out further of said fluid passage by said knife opposite side.

9. A fluid dispenser attached to an opening in a flexible walled fluid container, comprising:

a first tubular member having a first fluid outlet in one sidewall thereof and one end positioned in fluid communication with said container opening, a second tubular member having a second fluid outlet in one sidewall thereof and positioned within said first tubular member in a manner to be rotatable with respect thereto about a common longitudinal axis between a first position wherein said first and second fluid outlets are aligned and a second position wherein said first and second outlets are substantially sealed by an overlap of sidewalls of respective second and first tubular members, whereby fluid flow is permitted from within said second tubular member and out of said first and second outlets when said second tubular member is in its said first rotatable position while closing off such fluid flow when said second tubular member is in its second rotatable position, an end wall extending across a portion of an opening adjacent said one end of the first tubular member, said wall being substantially planar and perpendicular to said axis, a diaphragm extending across a remaining portion of the opening adjacent said one end of the first tubular member between its said end wall and sidewall and at an acute angle with respect to said longitudinal axis, thereby sealing said first tubular member one end, said diaphragm having a cutting track of varying thickness and width adjacent the sidewall of said first tubular member for a portion of a circumference thereof, and a knife positioned at one end of said second tubular member and adapted to travel along said diaphragm track when the second tubular member is rotated with respect to said first tubular member from said second rotatable position to said first rotatable position, whereby a first such rotation causes the knife to cut the diaphragm along said track to form a flap positioned out of a fluid path from the container opening into an interior of said second tubular member through said one and second tubular member first ends.

10. The fluid dispenser according to claim 9 wherein said knife includes a sharp edge along one side thereof that is its leading side as it cuts through said diaphragm along said cutting track in response to said second tubular member being rotated from its said second position to its said first position, an opposite side of said knife being blunt in order to push the cut diaphragm flap out of the fluid passage and partially underneath said end wall as the second member is rotated from said first position and back to said second position.

11. The fluid dispenser according to claim 10 wherein said knife additionally includes a notch in said opposite side adjacent a tip thereof, thereby allowing the cut diaphragm flap to be pushed further out of said fluid passage and underneath said end wall by said knife opposite side.

12. The fluid dispenser according to claim 9 wherein a distance between said first and second rotatable positions is substantially one-hundred eighty degrees.

13. The fluid dispenser according to claim 9 wherein said diaphragm cutting track includes first, second and third segments, the first track segment being of a given thickness and width, the second track segment having a greater thickness and width than the first segment, and the third track segment having a thickness and width that is less than those of said second segment and a width greater than that of said first segment.

* * * * *

UNITED STATES PATENT AND TRADEMARK OFFICE

CERTIFICATE OF CORRECTION

PATENT NO. : 5,111,970

DATED : May 12, 1992

INVENTOR(S) : Christopher C. Rutter, Terry Quashnick

It is certified that error appears in the above-identified patent and that said Letters Patent is hereby corrected as shown below:

Column 8, line 4, in Claim 9 replace "one" with---first---

Column 8, line 5, in Claim 9 replace "first" with---one---

Signed and Sealed this

First Day of February, 1994

Bruce Lehman

BRUCE LEHMAN

*Commissioner of Patents and Trademarks*

*Attest:*

*Attesting Officer*